US008764424B2

(12) United States Patent
Kirkland

(10) Patent No.: US 8,764,424 B2
(45) Date of Patent: Jul. 1, 2014

(54) SCREW PUMP WITH FIELD REFURBISHMENT PROVISIONS

(75) Inventor: Timothy M. Kirkland, Willard, MO (US)

(73) Assignee: Tuthill Corporation, Burr Ridge, IL (US)

( * ) Notice: Subject to any disclaimer, the term of this patent is extended or adjusted under 35 U.S.C. 154(b) by 230 days.

(21) Appl. No.: 13/068,622

(22) Filed: May 16, 2011

(65) Prior Publication Data

US 2011/0293459 A1 Dec. 1, 2011

Related U.S. Application Data

(60) Provisional application No. 61/395,707, filed on May 17, 2010.

(51) Int. Cl.
*F01C 1/16* (2006.01)
*F03C 2/00* (2006.01)
*F03C 4/00* (2006.01)

(52) U.S. Cl.
USPC ..... 418/201.1; 418/9; 418/179; 418/181

(58) Field of Classification Search
USPC ..... 418/9, 201.1, 178, 179, 181
See application file for complete search history.

(56) References Cited

U.S. PATENT DOCUMENTS

| | | | | |
|---|---|---|---|---|
| 1,492,846 | A | 5/1924 | Holweck | 415/72 |
| 2,442,254 | A | 5/1948 | Whitfield | 403/30 |
| 2,658,604 | A | 11/1953 | Erdmenger et al. | 198/533 |
| 2,691,482 | A | 10/1954 | Ungar | 418/1 |
| 2,730,297 | A | 1/1956 | Van Dorsten et al. | 415/72 |
| 3,074,624 | A | 1/1963 | Nilsson et al. | 418/9 |
| 3,802,809 | A | 4/1974 | Vulliez | 418/5 |
| 3,807,911 | A | 4/1974 | Caffrey | 418/9 |
| 4,078,653 | A | 3/1978 | Suter | 198/625 |
| 4,591,322 | A | 5/1986 | Ono et al. | 418/48 |

(Continued)

FOREIGN PATENT DOCUMENTS

| | | | |
|---|---|---|---|
| DE | 19749572 | A1 | 11/1997 |
| DE | 19820523 | A1 | 5/1998 |

(Continued)

OTHER PUBLICATIONS

EP European Search Report. Appln. No. EP 11 00 4065: Publication No. EP 2 388 482 (Al): Date of Publication: Nov. 23, 2011.

(Continued)

*Primary Examiner* — Theresa Trieu
(74) *Attorney, Agent, or Firm* — Jonathan A. Bay

(57) ABSTRACT

A screw pump (20) with field refurbishment provisions has screws (40), a base (26), and shafts (50) for the screws (40). The screws (40) have helical flights that intermesh during rotation, and extend between inner and outer ends (44 and 42). The shafts (50) extend between inner and outer ends (68 and 74), and are cantilevered from the base (26) from about the inner end (68) thereof. Each screw (40) is formed with a hollow core (80) for receiving its shaft (50) such that the screw (40) slips onto the respective shaft (50) therefor over the outer end (74) of its shaft (50). The screw pump further includes a keyless locking mechanism (56, 58, 96, or 98) intermediate each shaft (50) and screw (40), which is operative to rotationally lock the shaft (50) and screw (40) together without a key or keyway.

17 Claims, 10 Drawing Sheets

(56) References Cited

U.S. PATENT DOCUMENTS

| | | | | |
|---|---|---|---|---|
| 4,684,317 | A | 8/1987 | Luijten et al. | 415/73 |
| 4,714,418 | A | 12/1987 | Matsubara et al. | 418/201 |
| 4,792,294 | A | 12/1988 | Mowli | 418/9 |
| 4,797,068 | A | 1/1989 | Hayakawa et al. | 417/201 |
| 5,049,354 | A | 9/1991 | Nishimura | 420/27 |
| 5,120,208 | A | 6/1992 | Toyoshima et al. | 418/201.3 |
| 5,154,595 | A | 10/1992 | Takeda | 418/201.1 |
| 5,195,881 | A | 3/1993 | George, Jr. | 418/97 |
| 5,197,861 | A | 3/1993 | Maruyama et al. | 417/42 |
| 5,267,837 | A | 12/1993 | Mowli | 417/53 |
| 5,271,719 | A | 12/1993 | Abe et al. | 417/26 |
| 5,302,089 | A | 4/1994 | Maruyama et al. | 417/199.1 |
| 5,352,097 | A | 10/1994 | Itou et al. | 417/42 |
| 5,374,173 | A | 12/1994 | Maruyama et al. | 418/201.01 |
| 5,443,644 | A | 8/1995 | Ozawa | 118/715 |
| 5,449,276 | A | 9/1995 | Maruyama et al. | 417/205 |
| 5,478,210 | A | 12/1995 | Maruyama et al. | 417/203 |
| 5,632,597 | A * | 5/1997 | Hiroki et al. | 415/90 |
| 5,667,370 | A | 9/1997 | Im | 418/9 |
| 5,674,063 | A | 10/1997 | Ozaki et al. | 418/201.3 |
| 5,709,537 | A | 1/1998 | Maruyama et al. | 417/410.4 |
| 5,829,957 | A | 11/1998 | Ozaki et al. | 417/304 |
| 5,836,746 | A | 11/1998 | Maruyama et al. | 417/44.1 |
| 5,904,473 | A | 5/1999 | Dahmlos et al. | 417/410.4 |
| 5,938,420 | A | 8/1999 | Teraoka | 418/201.1 |
| 5,951,266 | A | 9/1999 | Maruyama et al. | 417/410.4 |
| 5,975,867 | A | 11/1999 | Grant et al. | 418/107 |
| 6,125,994 | A | 10/2000 | Todome | 198/806 |
| 6,139,298 | A | 10/2000 | Kojima et al. | 148/152 |
| 6,176,694 | B1 | 1/2001 | Fang et al. | 418/194 |
| 6,257,839 | B1 | 7/2001 | Fang et al. | 417/283 |
| 6,257,854 | B1 | 7/2001 | Fang et al. | 418/194 |
| 6,312,242 | B1 | 11/2001 | Fang et al. | 418/201.1 |
| 6,341,951 | B1 | 1/2002 | Chen et al. | 418/9 |
| 6,359,411 | B1 | 3/2002 | Kosters et al. | 318/700 |
| 6,371,744 | B1 | 4/2002 | Mito et al. | 418/179 |
| 6,382,930 | B1 | 5/2002 | Bahnen et al. | 417/310 |
| 6,508,639 | B2 | 1/2003 | Chen et al. | 418/9 |
| 6,544,020 | B1 | 4/2003 | Bahnen et al. | 418/88 |
| 6,702,558 | B2 | 3/2004 | Becher | 418/201.1 |
| 6,758,660 | B2 | 7/2004 | Kriehn et al. | 418/91 |
| 6,783,342 | B2 | 8/2004 | Norman et al. | 418/206.1 |
| 6,863,511 | B2 | 3/2005 | Kriehn et al. | 418/201.1 |
| 6,929,807 | B1 | 8/2005 | McAnalley et al. | 424/725 |
| 6,964,559 | B2 | 11/2005 | Behling et al. | 417/410.4 |
| 6,964,560 | B2 | 11/2005 | Yoshimura | 418/201.1 |
| 7,008,200 | B2 | 3/2006 | Holtzapple et al. | 418/168 |
| 7,484,943 | B2 | 2/2009 | Izawa et al. | 418/9 |
| 7,553,138 | B2 | 6/2009 | Gorban | 418/48 |
| 7,946,828 | B2 | 5/2011 | Ovsthus et al. | 417/68 |
| 2002/0031439 | A1 | 3/2002 | Chen et al. | |
| 2006/0216189 | A1 | 9/2006 | Ohmi | |
| 2007/0041861 | A1 | 2/2007 | Ozawa et al. | |
| 2008/0044304 | A1 | 2/2008 | Izawa et al. | |

FOREIGN PATENT DOCUMENTS

| | | |
|---|---|---|
| DE | 19963173 | 12/1999 |
| FR | 1290239 | 5/1962 |
| JP | 56014887 | 2/1981 |
| JP | 62023501 | 1/1987 |
| JP | 01134091 | 5/1989 |
| JP | 1187391 | 7/1989 |
| JP | 01262399 | 10/1989 |
| JP | 3111690 | 5/1991 |
| RU | 1820035 | 1/1991 |
| SU | 424983 | 12/1971 |
| WO | WO0148384 | 7/2001 |

OTHER PUBLICATIONS

EP Extended European Search Report, Appln. No. EP 11 00 4065; Date of Report Oct. 5, 2011.

* cited by examiner

SCREW PUMP WITH FIELD REFURBISHMENT PROVISIONS

CROSS-REFERENCE TO PROVISIONAL APPLICATION(S)

This application claims the benefit of U.S. Provisional Application No. 61/395,707, filed May 17, 2010, the disclosure of which is incorporated herein by this reference thereto.

BACKGROUND OF THE INVENTION

The invention relates to screw pumps and, more particularly, to a screw pump with field refurbishment provisions.

Screw pumps typically comprise at least two screws which extend axially from a suction end to a discharge end, and with helical flights intermeshing with each other during rotation. The screws are typically housed within a screw housing that likewise extends axially from a suction end to a discharge end.

Screw pumps can be classified according to several factors. Two such factors include (1) whether the screw and shaft are separate pieces or are formed as a monolithic unit, and (2) whether the screw is supported from one end only or both ends.

When the screws and shafts are separate pieces, the screws typically slide onto their shafts by means of central bores through the screws, and the conventional prior art method of rotationally fixing each screw to its respective shaft is by use of keys and keyways. When the screw is formed as a monolithic unit with its shaft, the monolithic-unit construction obviates the possibility for keys and keyways needless to say, and the shaft portions may be referred to not as shafts but shaft stubs.

One- and two-piece construction aside, there are two different styles of screw support. Namely, when the screw is supported from one end only, this is referred to as a cantilevered-style screw pumps. While referred to as cantilevered screws, the screw orientation is typically vertical instead of horizontal, with the suction end being high and discharge end low. The shaft (or shaft-stub) for the screw typically projects (depends) from the discharge end, as into a bearing-and-seal carrier, which is where the bearings, seals and drive source are all coupled to the shaft (or shaft stubs). There is no need for any projections beyond the suction end of the screw because there are typically no bearings and no seals at that end of the screw.

The other style of screw support is referred to as simply-supported. Like cantilevered screws, simply-supported screws extend between a suction end and a discharge end. Unlike cantilevered screws, the shafts (or shaft stubs) for simply-supported screws stick out of both ends, because the screw is supported by a bearing at both ends. Simply-supported screws typically also have bearing seals at both ends too.

The shafts for both simply-supported screws as well as for cantilevered screws are typically driven at one end only, and typically this is the portion of the shaft that sticks out the discharge end. Typically, each of the two parallel shafts has a helical gear affixed to it, intermeshing with the helical gear of the other shaft. One shaft is directly driven, and the other shaft is driven off the directly-driven shaft.

Screw pumps of all types have various shortcomings when it comes to service. Screws pumps are most often employed in use environments where they are pumping compressible media, which can be carrying anything from corrosive and/or abrasive materials, to other materials including without limitation materials which leave a coating on the flights of the screws. After extended operation, the screw pumps need to be taken offline and serviced. The screws might need to be withdrawn from the shafts and cleaned or replaced. To do this typically requires extensive disassembly of the screw pump, not only for removal of the screw housing from the bearing-and-seal carrier, but also tearing into the bearing-and-seal carrier too in order to re-time the screws.

Each instance of re-assembly of the screws requires an operation referred to as 'timing.' Timing involves adjusting the relative angular orientation of the screws relative to each other for the proper intermeshing and clearance of their respective helical flights during rotation. Again, the shafts typically have helical gears. The helical gears are typically accessed by removing the screw housing from the bearing-and-seal carrier, and then tearing into the bearing-and-seal carrier. At least one helical gear is loosened off its shaft, rotated about its shaft, and then re-tightened in order to properly time the clearance of the flights with each other.

After that, the seals are replaced, the bearing-and-seal carrier is closed back up, the screw housing is re-mounted and so on.

What is needed are improvements in order to simplify the foregoing and overcome shortcomings of the prior art in connection with field refurbishment of screw pumps.

SUMMARY OF THE INVENTION

It is an object of the invention to rotationally lock the shaft and a screw of a screw pump together without use of a key and keyway.

It is another object of the invention that timing adjustment such a screw pump is done not with timing gears but between the screw shaft and screw.

It is an alternate object of the invention that timing adjustment such a screw pump is done at the top of the screw pump, with the screw pump fully assembled.

It is an additional object of the invention to enable the unfastening and sliding withdrawal of the screws out of the screw pump without disassembly of the screw pump.

It is a further object of the invention to enable service the seals without completely disassembling the screw pump.

It is an alternative object of the invention to use of materials with dissimilar coefficients of thermal expansion for the screws and shafts therefor such that, at cool-ambient temperatures there is a slip fit therebetween, but at operating temperatures there is an interference fit that promotes the centering and positive locking of the screws to their shafts.

These and other aspects and objects are provided according to the invention in a screw pump provided with various field refurbishment provisions. Such a pump preferably comprises at least two screws, a base, and shafts for the screws. The screws have helical flights intermeshing with each other during rotation. The screws also extend between inner and outer ends. The shafts extend between an inner and outer end, and are also cantilevered from the base from about the inner end. Each screw is formed with a hollow core for receiving the shaft such that the screw slips onto the respective shaft therefor over the outer end of that shaft.

It is an aspect of the invention to include a keyless locking mechanism intermediate each shaft and screw. The keyless locking mechanism is operative to rotationally lock the shaft and screw together without a key or keyway.

It is preferable that the keyless locking mechanism is releasable (ie., can be unlocked by a user) such that the timing between the screws can be adjusted by rotationally slipping the screws about the shafts.

It is furthermore preferred that the keyless locking mechanism is not only disposed intermediate the respective shaft and screw for it but also disposed proximate the outer ends of its screw and shaft.

The screw pump might further comprise a screw housing. Such a screw housing extends between an inner end and an outer end such that it is cantilevered from the base proximate the inner end thereof. The screw housing is formed with a screw chamber for receiving the screws while on their shafts. It is an additional aspect of the invention that releasing the keyless locking mechanism allows the screws to be removed from their shafts without removing the screw housing from the base.

Each shaft is preferably formed with and instep proximate the outer end, and this instep produces a shoulder. Wherein the portion of the screw shaft that is stepped-in beyond the shoulder and defines an annular cavity with the hollow core in the screw. It is this annular cavity that provides working room for the introduction and functioning of the keyless locking mechanism.

It is another aspect of the invention that the keyless locking mechanism can take any form such as and without limitation any one of an axial clamping arrangement, a drift-free style of keyless bushing, a lift-style of keyless bushing, or a sink-style of keyless bushing.

It is a further aspect of the invention that the screws are produced of materials having coefficient of thermal expansion properties while, in contrast, the shafts are produced of dissimilar materials having coefficient of thermal expansion properties that are higher in value than the coefficient of thermal expansion properties of the screws across a temperature range from ambient to operating temperatures. That way, whereas the screws and shafts have a slip fit at ambient temperatures, the screws and shafts also have an interference fit at operating temperatures that further promotes the positive locking of the screws to their shafts.

The base has a panel which the inner end of the screw housing is cantilevered off of. The screw pump optionally further comprising seal assemblies which encircle the shafts proximate the inner ends thereof and proximate a surface of the panel of the base. It is moreover another aspect of the invention that the seal assemblies are accessibly mounted so that they can be replaced after removal of the screws and screw housing but without removal of the shafts or access to behind the panel from inside the base.

The axial clamping arrangement comprises a pair of jaws connected to or formed on the shaft, wherein at least one driven jaw is movable to produce clamping pressure. The movable jaw optionally comprises a ring which fits inside the annular cavity between the necked-in shaft beyond the shoulder thereof and the core in the screw proximate the outer end thereof. To do this, the movable jaw is optionally driven by threaded rod engaged to the shaft at the shoulder. Each shaft is configured with an inner and outer seat upon which the jaws of the axial clamping arrangement clamps onto. The locking of the screws to the shaft might be achieved by any combination of two keyless locking technologies.

The screw pump alternatively comprises a series of fasteners for mounting the screw housing to the panel of the base, wherein the screw housing can be replaced from the base without disturbing the shafts or the panel on the base, or else without gaining access behind the panel from inside the base.

In one preferred embodiment of the invention, the shaft comprises a steel alloy and the screw comprises a material with about zero percent (0%) thermal expansion over the temperature range from ambient to operating temperature. In general, the screws are hotter near their inner ends than their outer end at operating temperature. Therefore, the interface pressure between shaft and the core of the screw is correspondingly going to be greater nearer the inner ends than nearer the outer ends.

A number of features and objects of the invention will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
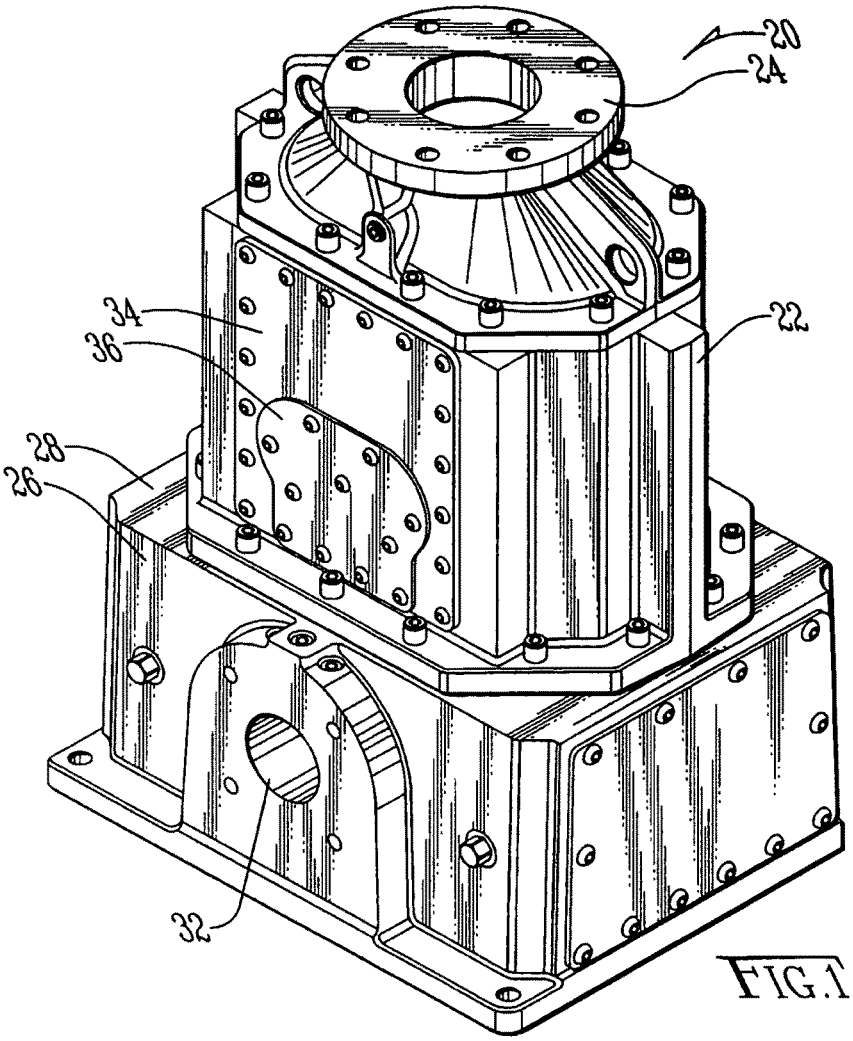
FIG. 1 is a perspective view of a screw pump with field refurbishment provisions in accordance with the invention.

FIG. 1 shows a screw pump 20 with bypass and field refurbishment provisions in accordance with the invention. This screw pump 20 is a cantilevered-style screw pump, as discussed above. The screw pump 20 has a screw housing 22 sandwiched between a suction port housing 24 and a bearing-and-seal carrier 26 or, more accurately, the top panel 28 thereof. The bearing-and-seal carrier 26 is formed with a discharge port 32. The screw housing 22 is includes a water jacket cover plate 34 and bypass cover plate 36.

Figure 2:
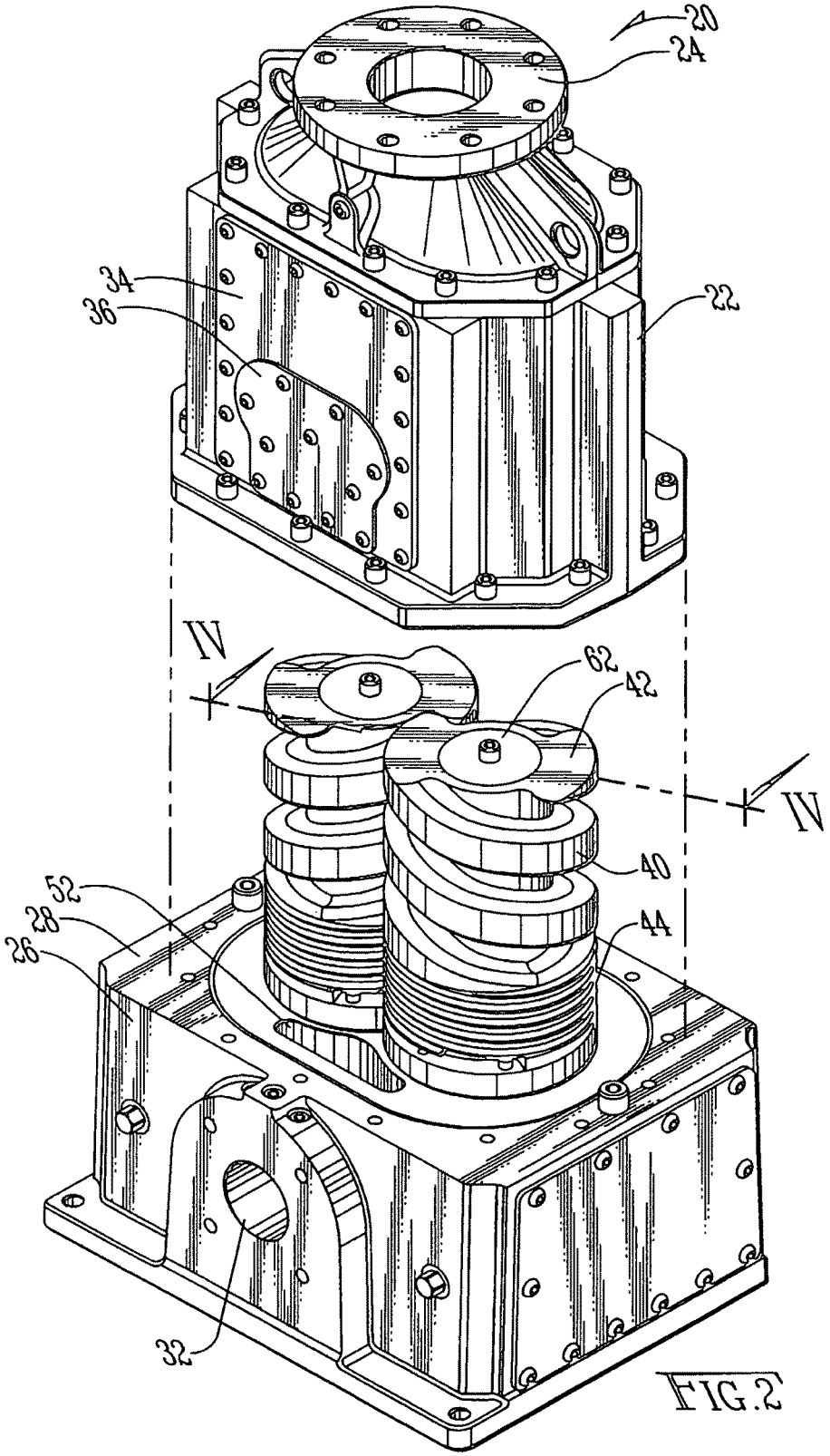
FIG. 2 is a perspective view comparable to FIG. 1 except showing disassembly of the screw housing from the screw pump.
Figure 3:
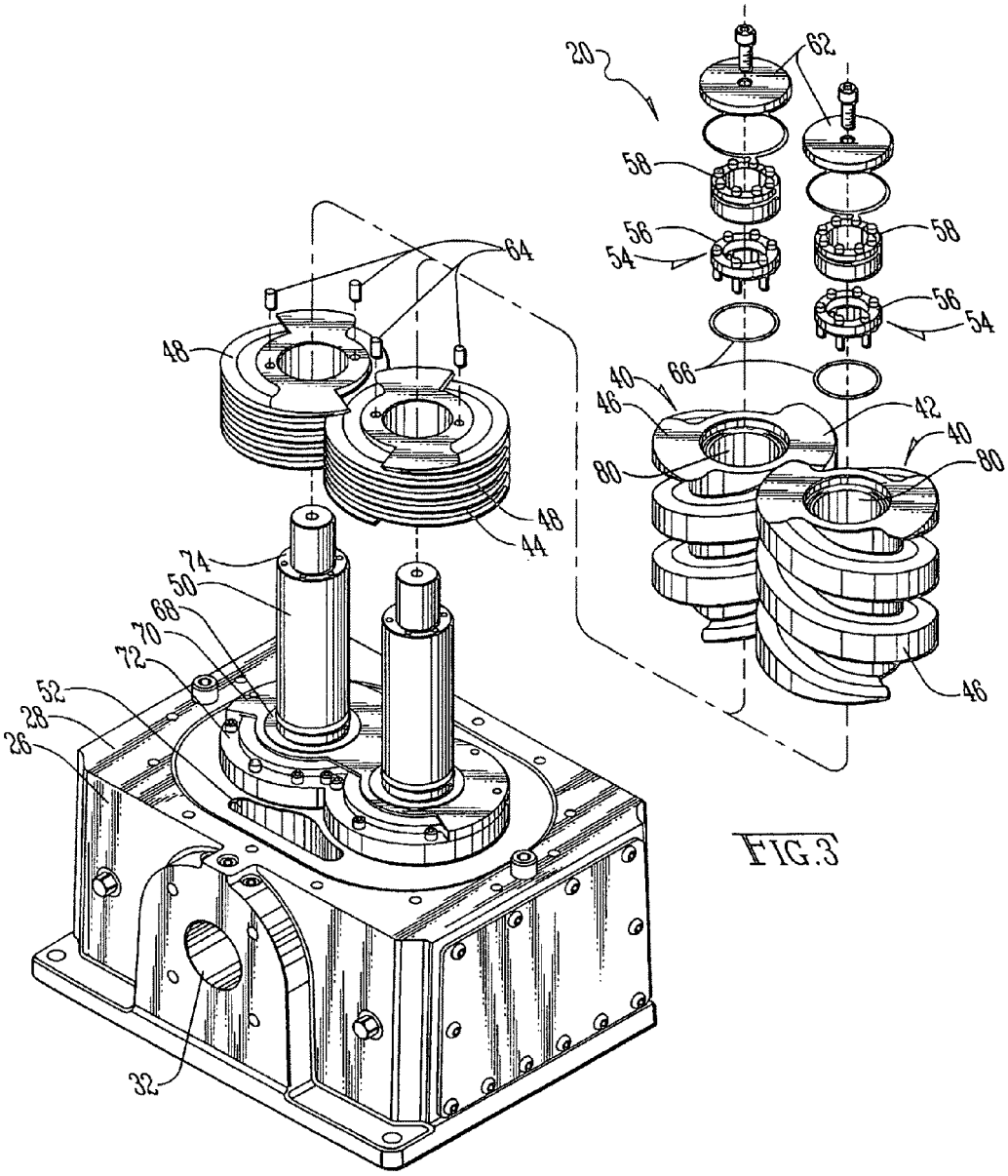
FIG. 3 is a perspective view comparable to FIG. 2 except comprising an exploded view thereof.

FIG. 2 shows that the screw pump 20 comprises a pair of mirror opposite screws 40 that are turned counter rotational to each other. The screws 40 extend between a suction or inlet end 42 and a discharge end 44. FIG. 3 shows that each screw 40 comprises a first stage 46 of helical flights and a second stage 48 of helical flights. The flights for the second stage 48 are finer than the flights for the first stage 46, which are relatively more coarse.

The discharge port 32 is the termination of a discharge plenum (hidden from view) that courses through the bearing-and-seal carrier 26. FIGS. 2 and 3 show the inner opening 52 of such discharge plenum (which again, is hidden from view, but which port 32 is its outlet).

FIG. 3 shows that the screws 40 are connected to their screw shafts 50 in part by keyless locking mechanisms 56 and 58. It is an aspect of the invention that the keyless locking mechanisms 56 and 58 are accessed at the suction ends 42 of the screws 40. The screws 40 have central bores 80 which sized for a very close slip fit over screw shafts 50 when at ambient temperature. Again, this is referred to an ambient-temperature slip fit between the screw shafts 50 and shaft bores 80. The keyless locking mechanisms 56 and/or 58, in part, combat this ambient-temperature 'slip' fit. The keyless locking mechanisms 56 and/or 58, in part, hold the timing between the screws 40. Again, timing concerns relative angular orientation of the screws 40 relative to each other for the proper intermeshing and clearance of their respective helical flights during rotation.

Figure 4:
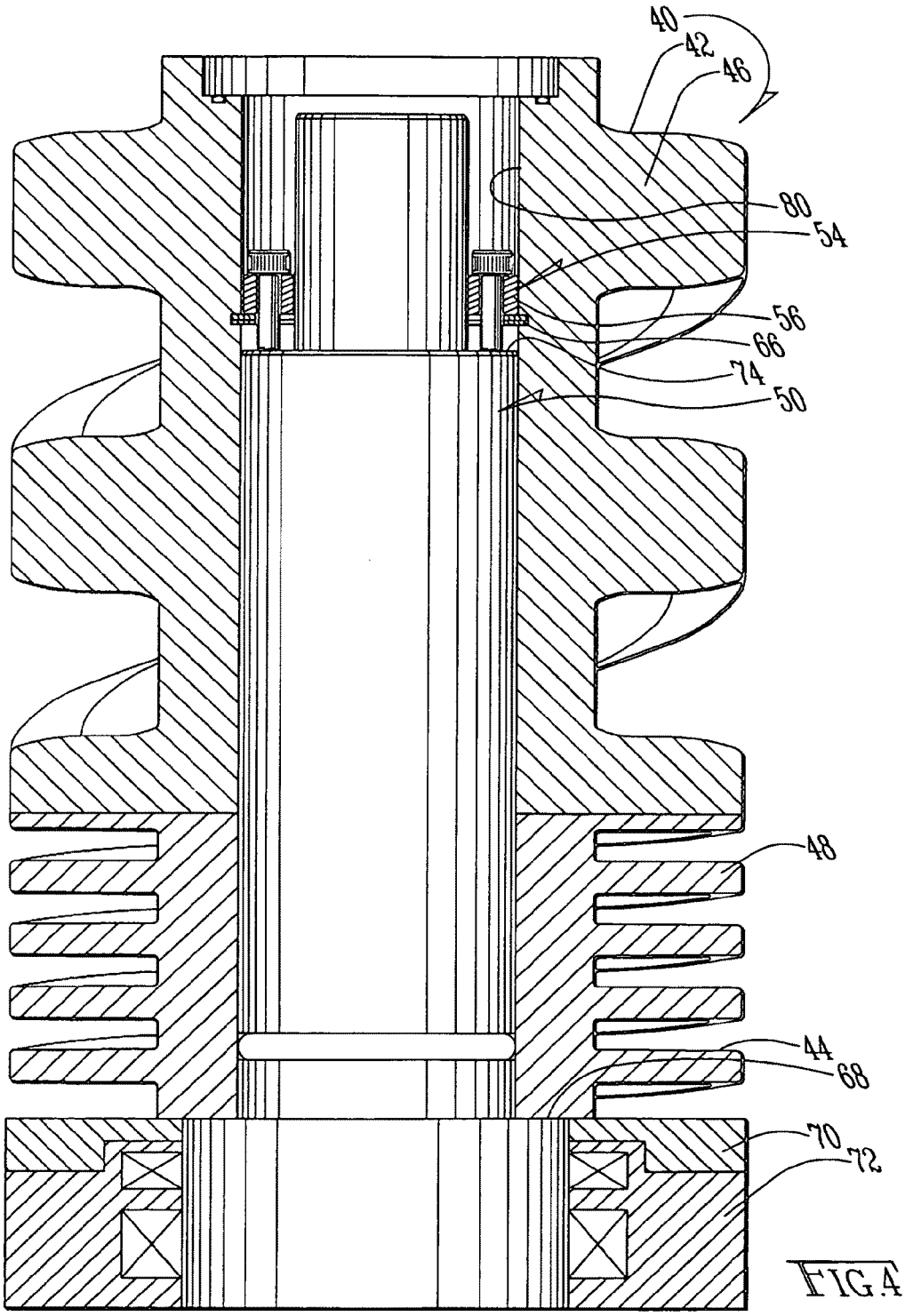
FIG. 4 is an enlarged-scale partial section view taken along line IV-IV in FIG. 2, except with cover washer (62) and keyless bushing (58) removed view.

As better shown in FIGS. 3 and 4, the keyless locking mechanism 56 comprises a series of components and features which in concert provide an axial clamping force on the screw 40 to its shaft 50. The keyless locking mechanism 56 includes a ring 54 that serves as a moving jaw 54. The screw shaft 50 is formed with a pair of insteps, each creating a shoulder. A first instep for the screw shaft 50 transitions from a relatively large diameter to an intermediate diameter, and forms the inner shoulder 68 (the reference to 'inner' refers to shoulder being relatively closer to the bearing-and-seal carrier 26 than the next shoulder to be described). A second instep for the screw shaft 50 transitions from the intermediate diameter to a relatively small diameter and form the outer shoulder 74. The outer shoulder 74 is nearer the suction end 24 of the pump 20. The stepped-in screw shaft 50 beyond the outer shoulder 74 defines an annular cavity with the bore 80 in the screw 40. This annular cavity provides working room for the introduction and functioning of the keyless locking mechanisms 56 and 58.

The inner shoulder 68 serves as the axial clamp's (eg., 56) fixed jaw. The screw 40's discharge end 44 serves as the seat which abut against the inner shoulder 68. The outer shoulder 74 serves as the anchorage for a circle of machine screws to pull the moving jaw 54 onto something connected to the screw 40 and thereby develop the axial clamping power. For this purpose, the outer shoulder 74 is tapped with a circular pattern of threaded sockets for the machine screws to tighten into. The ring 54 has a corresponding pattern of through holes for the machine screws to slide through. receiving threaded fasteners. Since the moving jaw 54 needs something on the screw 40 to bear down on, the screw 40 is configured with the following. The central bore 80 of the screw 40 is formed with a recessed-in, annular ring groove near the suction end 42 of the screw 40. This ring groove receives removable retaining ring 66. Indeed, it is preferred to use a spiral retaining ring 66.

Given the foregoing, the ring jaw 54 is tightened and slackened relative the fixed jaw (inner shoulder 68) by the circular pattern of machine screws fasteners that twist into the threaded sockets in the outer shoulder 74.

Hence the keyless locking mechanism 56 forms an axial clamping arrangement, putting clamping compression between the retaining ring 66 of the screw 40 and the discharge end 44 of the screw 40, which serves as a seat against the inner shoulder 68.

Figure 5:
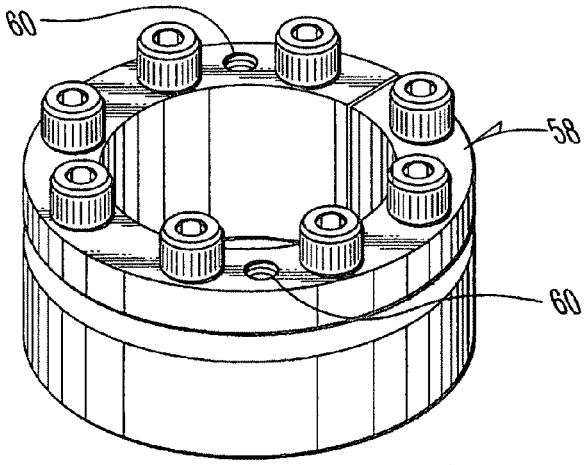
FIG. 5 is an enlarged scale perspective view of the keyless bushing (58) in FIG. 3.
Figure 6:
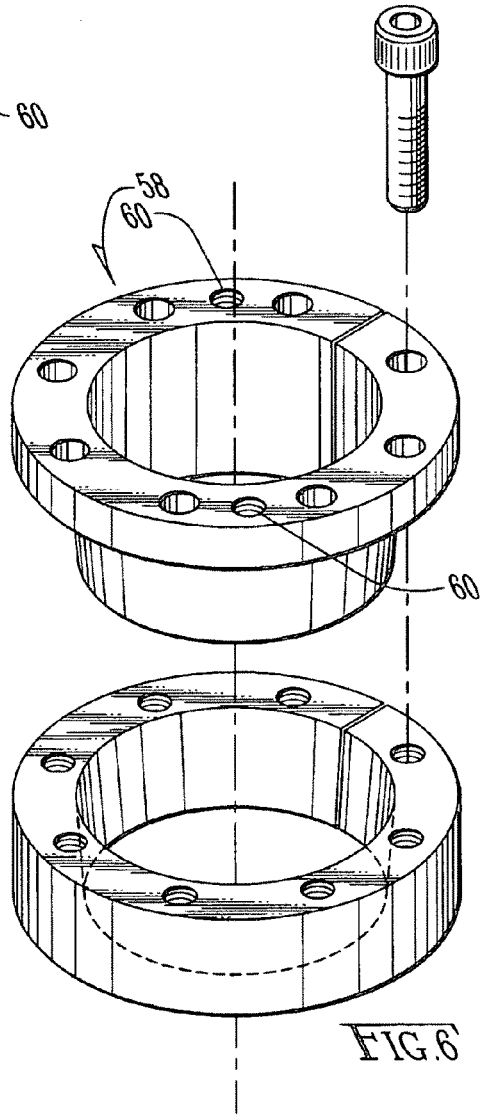
FIG. 6 is a perspective view comparable to FIG. 5 except comprising an exploded view thereof.
Figure 7:
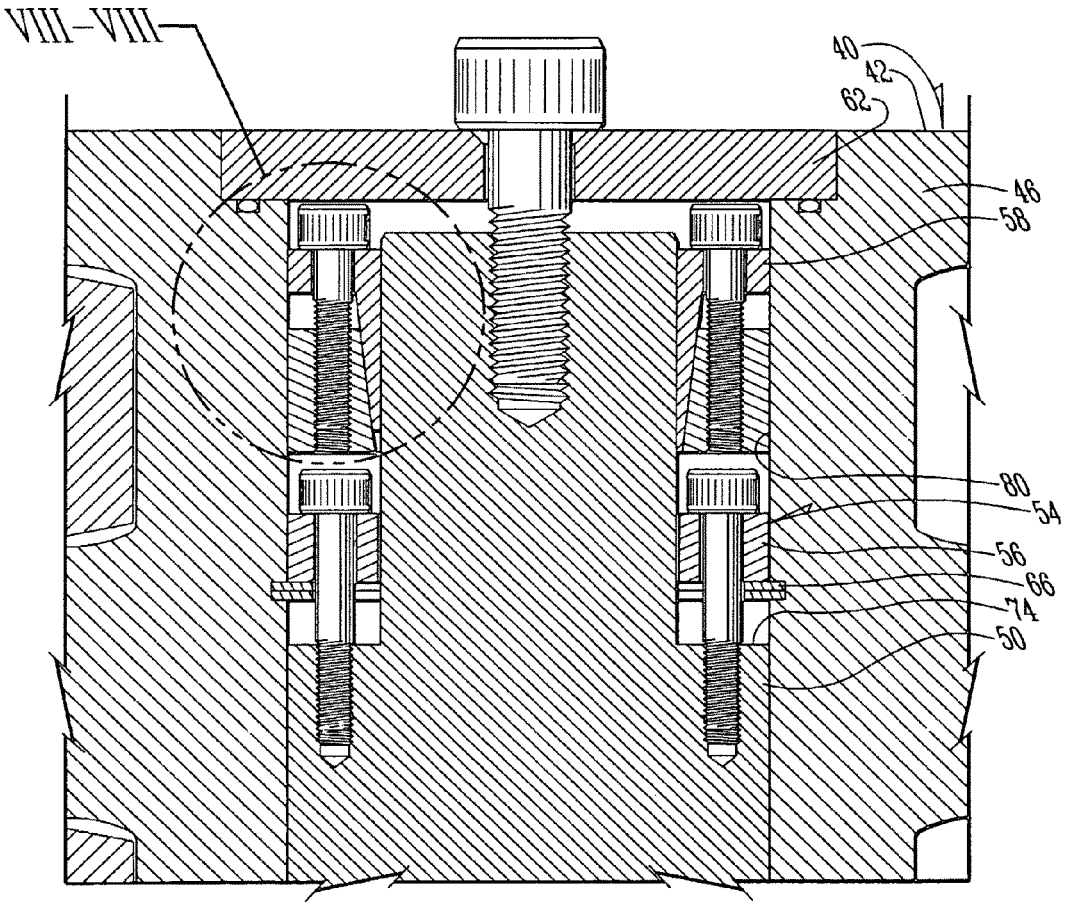
FIG. 7 is a partial section view comparable to FIG. 4 except on an enlarged scale and with portions broken from view, but also except with the cover washer (62) and keyless bushing (58) returned to the view.
Figure 8:
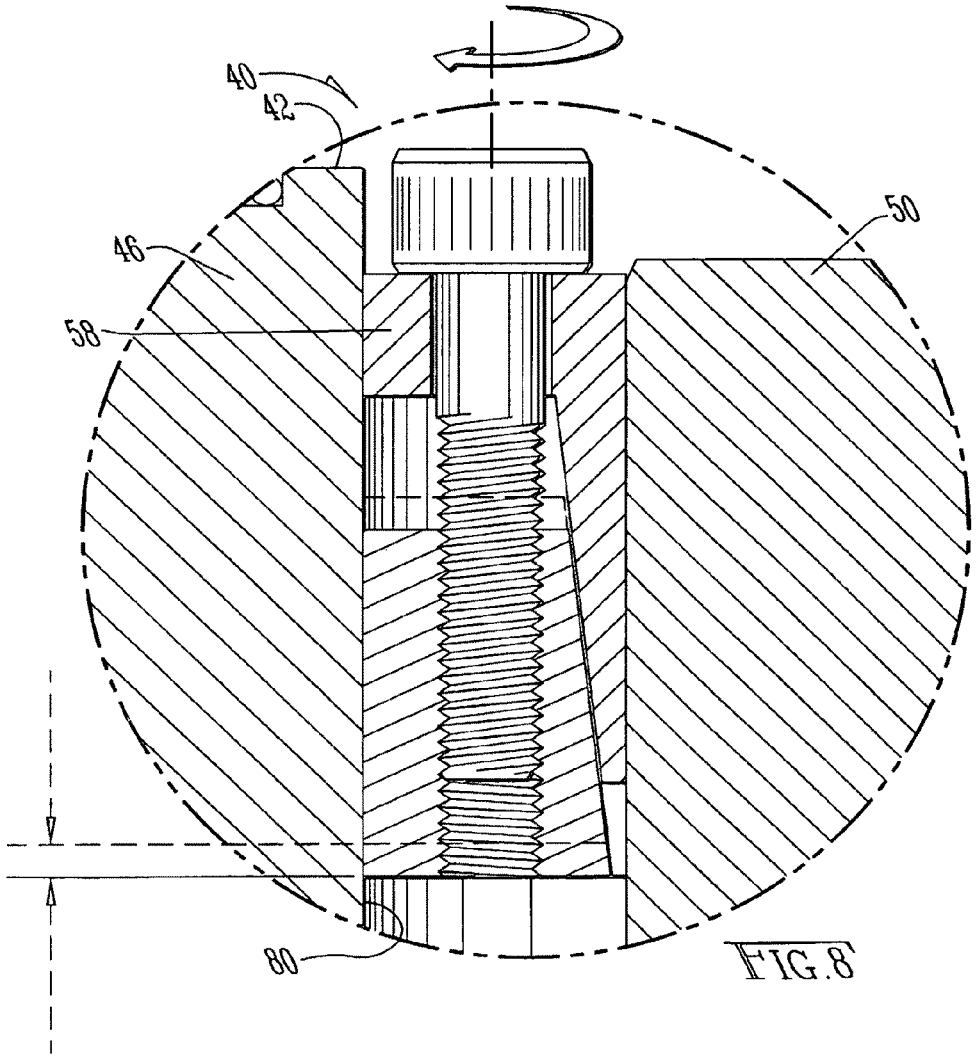
FIG. 8 is an enlarged-scale partial section view of detail VIII-VIII in FIG. 7.

As shown better by FIGS. 3 and 4 through 8, the keyless locking mechanism 58 comprises an annular compression fitting known as a keyless bushing 58. More particularly still, this keyless bushing 58 comprises a particular style of keyless bushings, one of three such styles, this one here being referred to as a lift-style keyless bushing 58. FIGS. 3 and 7 show a cover washer 62 with O-rings for sealing out dirt. The machine screws for retaining ring 54 as well as the keyless bushing 58 are both accessed after the removal of the cover washer 62. Suitable keyless bushings are available from and without limitation Fenner U.S., Inc., of Wilmington, Del., under the brand name B-LOC®.

The keyless bushing 58 comprises a pair of interfitting split collars, once comprising a flanged inner collar and the other a ring outer collar. The flanged inner collar has a cylindrical inner wall for clamping against the neck-in portion of the shaft 50 above the outer shoulder 74. The ring outer collar has a cylindrical outer wall for bearing against the sidewall of the shaft bore 80 inside the screw 40. The pair of collars interfit with a pair of conic tapered sections. Machine screws slide through a circular pattern of the through holes in the flange of the flanged inner collar and twist into threaded sockets for them in the ring outer collar. Tightening the machine screws causes the keyless bushing 58 as a unit to wedge in place and provide a radial clamping force between the shaft 50 and screw 40.

FIGS. 5 and 6 show that the flange of the flanged inner collar is provided with threaded through holes. At some time in the future long past when the keyless bushing 56 was originally tightened, it will be desirable to loosen the keyless bushing 56. But just loosening the machine screws shown in FIG. 5 will not be enough to do the job. Machine screws will have to be tightening into threaded holes 60 in order to force the two collars apart (this is not shown).

In a preferred embodiment of the invention, it is preferred incorporate a pair of keyless locking mechanisms 56 and 58 for each screw 40 and screw shaft 50. The keyless locking mechanism 56 serves to produce an axial clamping force. The keyless locking mechanisms 58 serves to produce a radial clamping force. However, this design preference is for convenience only.

Trials have determines that the keyless bushing 58 can adequately handle the transmission of the entire rated torque load, not only while cool at the start, but easily too at temperature when running. However, trials have also determined that tightening the keyless bushing 58 tends to lift the screw 40 'ever so slightly' relative to the shaft 50. But where tolerances are very tight, 'ever so slightly' is intolerable. Hence the axial clamping mechanism 56 neutralizes the lift tendency of the keyless bushing 58.

It was mentioned above that there are more than one style of keyless bushings. Keyless bushing 58 is referred to herein as a lift-style of keyless bushing. But according to this characteristic, there are at least two other styles of keyless bushings, and as shown by FIGS. 9 and 10 respectively.

Figure 9:
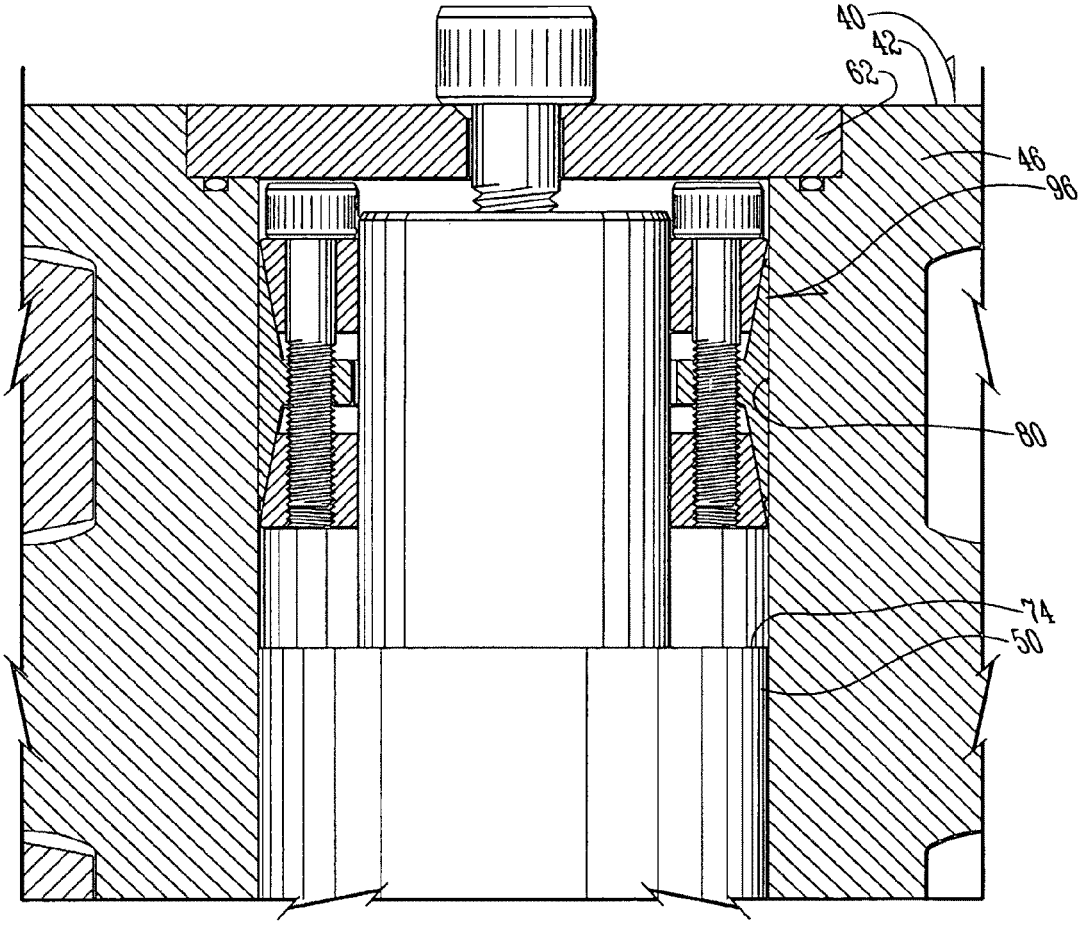
FIG. 9 is a partial section view comparable to FIG. 7 except showing an alternate embodiment of a keyless screw-to-shaft locking mechanism in accordance with the invention.

FIG. 9 shows a keyless bushing 96 with a pair of opposed, annular tapered interfaces. Accordingly, this is a drift-free style of keyless bushing 96. When tightened, this keyless bushing 96 neither tends to lift the screw 40 on the shaft 50, nor do the opposite.

Figure 10:
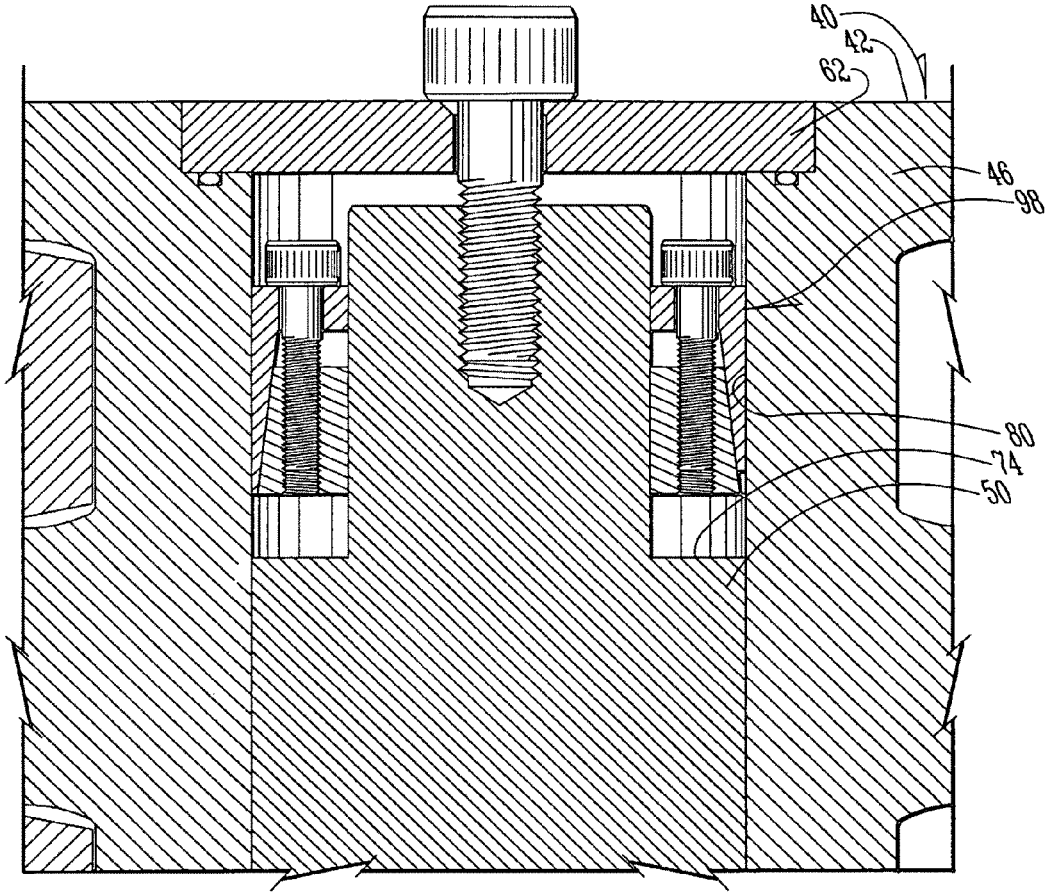
FIG. 10 is a partial section view comparable to FIGS. 7 and 9 except showing another embodiment of a keyless screw-to-shaft locking mechanism in accordance with the invention.

FIG. 10 shows a keyless bushing 98 having a single annular tapered interface, like keyless bushing 58 of FIGS. 3 and 4 through 8. However, in keyless bushing 98, the flanged collar which has a larger contact surface area than the ring collar has been switched around to the outer collar and bearing against the sidewall of the shaft bore 80. Tightening keyless bushing 98 tends to cause the opposite effect of keyless bushing 58.

That is, tightening keyless bushing 98 tends to induce the screw 40 to sink harder against the inner shoulder 68 of the shaft. Hence keyless bushing 98 is referred to a sink-style of keyless bushing.

Comparing FIGS. 9 and 10 with FIG. 7 shows that it is needless to combine either of keyless bushings 96 or 98 with axial clamping arrangement 56. In contrast, it is indeed preferred to useless axial clamping arrangement 56 in tandem with keyless bushing 56.

Returning to FIGS. 3 and 4, they show that each screw 40 is made of two pieces, comprising a first stage section 46 and a second stage section 48. The two stages 46 and 48 are angularly oriented to each other by dowels 64. The second stage 48 rotates above a discharge plate 70, which controls the discharge of the compressible media out discharge port 32. Below the discharge plate 70 are seal assemblies 72. The seal assemblies 72 incorporate gaskets and/or bearings (not indicated). Indeed, there might be one bearing per shaft 50 just underneath the discharge plate 70, and then one or more others per shaft deeper inside the bearing-and-seal carrier 26.

Pause can be taken to discuss 'timing adjustment.' That is, there is a factor in the design of dry screw vacuum pumps known as 'timing adjustment.' Briefly, 'timing' is a broader concept than 'timing adjustment' alone. Timing generally has two components to it. One is, that the screws 40 turn at the same speed. It is an aspect of the invention that screw shafts 50 are driven by synchronous gears which are in no way adjusted for timing adjustment. Again, it is common in the prior art to drive the shafts by helix gears, and do the timing adjustment there, between the helix gears and the shafts. But again, it is an aspect of the invention that screw shafts 50 are driven by constantly-meshed synchronous gears which are in not disturbed for such operations as timing adjustment.

Timing adjustment involves adjusting the relative angular orientation of the screws 40 to each other. It is an aspect of the invention that timing adjustment is achieved, not by between the gears and shafts 50, but by one or more of the keyless locking mechanisms 56, 58, 96 and/or 98 at the free (suction) end 42 of the screws 40.

The proper angular orientation between the screws 40 can be reckoned a lot of ways. For example, consider that a screw can be marked with an arbitrary point on its periphery. As the screw turns, this arbitrary point orbits in full rotations. As the other screw also turns, it has one specific counterpart point on its periphery likewise orbiting in full rotations. Timing adjustment is proper when the two points cross the plane between the screw shaft axes at the same time. Indeed it is required that, for every rotation, they not only cross that plane at the same time but do so with great precision. To get that right requires adjustment, indeed micro adjustment.

The conventional manufacture of screw pump screws 40 and screw pump screw shafts 50 is making them as (or locking them together as the equivalent of) a single monolithic unit. That is, if the screw 40 and shaft 50 were originally two separate pieces, but then keyed together by a key in a keyway, for all practical purposes, they will meld together as the equivalent of a monolithic unit after extended operation time.

Correspondingly, the conventional way of adjusting the timing is to do it with timing gears. That is, at least one gear is releasably clamped to its respective screw shaft such it can be slackened to allow angular adjustment between the screws.

Unlike synchronized speed, timing adjustment is not merely a 'do once' task in the manufacture and service life of a screw pump. Indeed, there are numerous times when the screws 40 need to be re-timed. The foregoing is a non-exhaustive list of such times:— original manufacture and installation, removal of the screws 40 (eg., for mechanical cleaning), replacement of worn out screws 40, replacement of worn out seals 72, replacement of worn out bearings, and so on.

Given the foregoing, it is readily appreciated that timing adjustment is a recurrent chore in the life of a screw pump. Again, for this screw pump 20, the shafts 50 are driven by synchronous gears. The orientation of this screw pump 20's synchronous gears to one another is irrelevant to timing adjustment.

As described above, the screws 40 fit on their shafts 50 by ambient-temperature slip fits. In the absence of any keyless locking mechanism between the screws 40 and shafts 50, angular orientation between them is infinitely adjustable. However, it is an aspect of the invention to incorporate keyless locking mechanisms 56, 58, 96 and/or 98 between the screws 40 and screw shafts 50.

Assembly between the screws 40 and screw shafts 50 might take place as follows. The first and second stage sections 46 and 48 of each screw are mated together and mutually oriented by means of the dowels 64. Next the screws 40 are meshed with each other in an approximately correct angular orientation to each other. The screws 40 are then slid over their bare screw shafts 50 until the discharge end 44 lands, and seats, upon the inner shoulders 68 of the screw shafts 50. The retaining ring 66 for each screw 40 is inserted into the ring groove for it inside the central bore 80 of the respective screw 40. The ring jaws 54 are slid down the screw shafts 50 and then the machine screws are threaded and tightened until clamping pressure between the jaws 54 and 68 firmly compress the screw 40 therebetween.

Among other things this accomplishes, it lightly fixes the relative angular orientation between the screws 40 to a fixed orientation. Likewise, it lightly fixes the relative axial orientation of the screws 40 on the screw shafts 50. However, it is preferred to augment the mechanical connection provided by the axial clamp (eg., 56) with a second keyless locking mechanism 58.

It is an alternative aspect of the invention to dispenses with dual keyless locking mechanisms 56 and 58 in favor of a single keyless locking mechanism 96 or 98 alone.

Now pause can be taken to discuss the 'field' refurbishment provisions in accordance with the invention for the inventive screw pump 20. Namely, this includes accessibility and/or replacement of the screws 40 and seals 72 in the 'field' (often a factory, but just not the OEM factory), and all with simple tools.

Dry screw vacuum pumps are put to a lot uses. Sometimes they pump clean gases. Other times they pump 'dirty' gas streams. For clean gases, dry screw vacuum pumps may run for years with trouble free performance. For dirty gas streams, years of trouble free service are unlikely. Entrained material in the dirty gas stream can cause failures in a short amount of time:—perhaps in a few months, perhaps in a few hours.

The majority of failures caused by dirty gas streams fall into two categories:—

(1) material build-up on the screws 40 (or in the screw chamber inside the screw housing 22), which closes clearances and creates contact (wherein failures of this category range from mild to severe) or, alternatively, (2) material erosion of the seals 72 that isolate the dirty gas stream from the bearings (or journals) supporting the screws 40 (wherein failures of this category typically only result in increased cost of operation since failures of this category are typically combated with a purge gas—eg., argon—being pumped into the screw chamber from below the seals 72).

More particularly, failures of the first category range from mild to various grades of severe. A mild failure might be solved by a simple back-flushing of the screw chamber to dislodge and blow-out the built-up material. Often, flushing does not solve the problem. In that case, the screw pump 20 might be taken out of service for a while and disassembled in order to mechanically clean the screws 40 and then also the screw chamber inside the screw housing 22.

It is an aspect of the invention to enable removal of the screw 40 off its shaft 50 without disassembly of the screw housing 22 off the bearing-and-seal carrier 26. It is another aspect of the invention to enable removal of the screws 40 without removing the screw shafts 50 off the rest of the pump 20 (ie., the bearing-and-seal carrier 26). Hence the screw pump 20 can be readily serviced in the 'field'—eg., in the customer's factory, but without having to be returned to the OEM factory.

If the screws 40 rub each other or the screw housing 22 so much that they seize, then probably the screws 40 and screw housing 22 are going to need to be replaced. To do this with all other dry screw vacuum pumps on the market requires prolonged removal from service and complete disassembly. In contrast, it is an aspect of the screw pump 20 in accordance with the invention that the screws 40 and screw housing 22 are readily changed out with interchangeable replacements.

That is, the screws 40 and screw housing 22 are bolt-on, self-contained modules that de-couple from the screw shafts 50 (in the case of the screws 40) or un-fasten off the top panel 28 of the bearing-and-seal carrier 26 (in the case of the screw housing 22) by means of mere hand tools. Damaged screws 40 or a screw housing 22 can be replaced on site, and again, all with common hand tools.

The design of the screw pump 20 allows workers to do the timing at the top of the pump 20, with only the housing 24 for the suction port removed, but otherwise with the pump 20 fully assembled while doing do.

As mentioned above, failures of the second category involve erosion of the seals 72. The seals 72 are not typically replaced if there is just minute erosion of them. That is, erosion of the seals 72 is usually tolerated for a while and combated by pressurizing the back of the seals 72 with a purge gas. The goal is to blow the material in the dirty gas stream away from the bearings for as long as possible. But, as the erosion widens the gap between the screw shafts 50 and the seals 72, the effectiveness of this diminishes and the seals 72 will eventually have to be replaced. In conventional dry screw vacuum pumps on the market, seal replacement requires complete disassembly of the pump because the seals are typically located deep within the pump.

It is an aspect of the pump 20 in accordance with the invention that, the seals 72 are replaceable as easily as the screws 40, because workers need not have to disassemble the pump 20 to the extent of removing the screw shafts 50.

Figure 11:
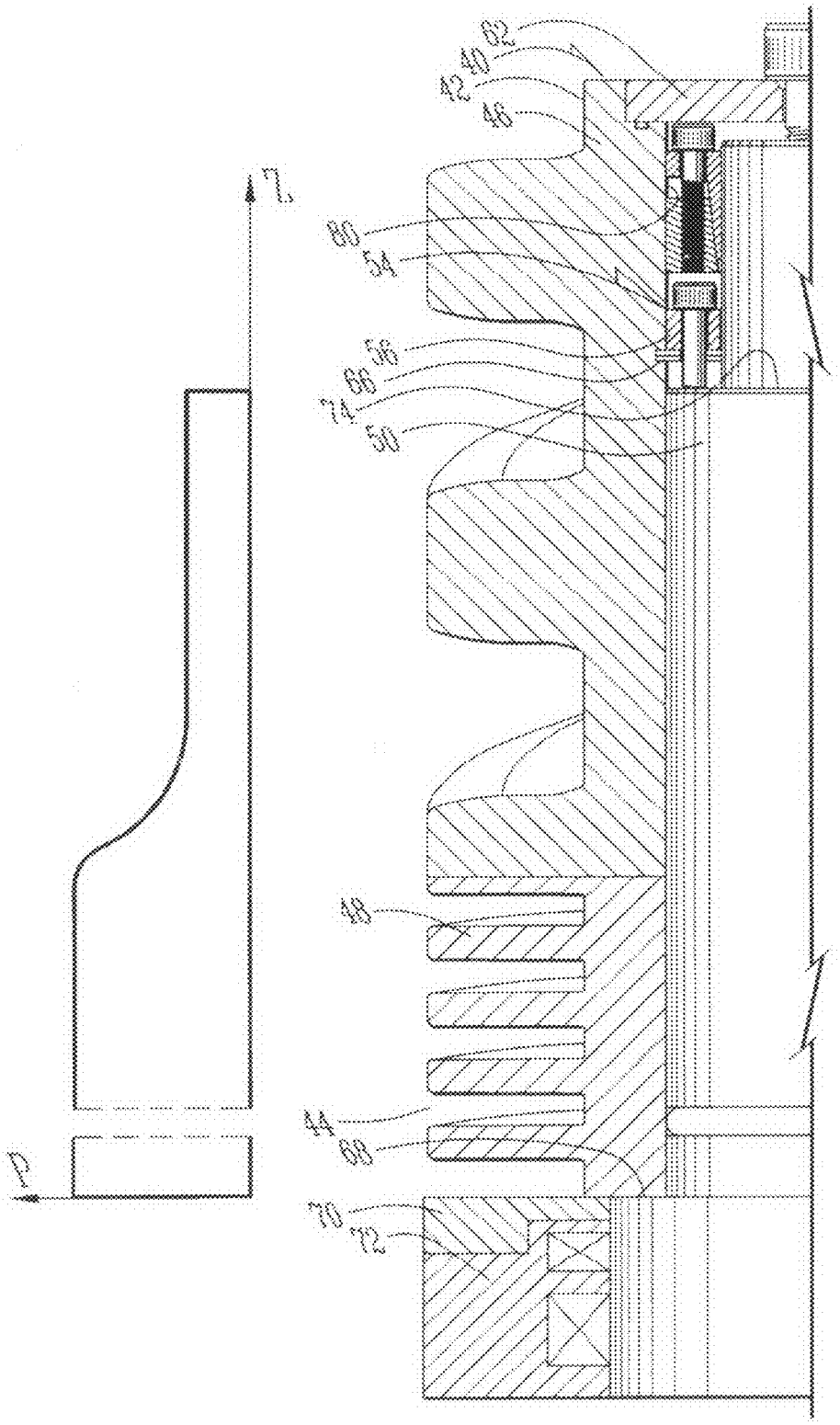
FIG. 11 is a partial section view comparable to FIG. 4 except with portions removed from and the view and showing a pressure-to-axis curve for the interface pressure between the screw and shaft after the hot running-temperature has been reached, and after the interference affect has taken affect.

To turn to FIG. 11, it is a further aspect of the invention to augment the torque-transmitting capacity by any of keyless locking mechanisms 56, 58, 96 and/or 98 by making the screws 40 and screw shafts 50 out of dissimilar materials.

Dry screw vacuum pumps develop heat, and stay pretty hot, during operation. Temperatures of 175° C. (–350° F.) are common near the discharge end 44 of the screws 40 (ie., the temperature is progressively hotter in the screw chamber in the screw housing 22 from the suction end 24 to the discharge end 32). It is an aspect of the invention to take advantage of this heat for the sake of coupling of the screws 40 to their screw shafts 50 even tighter still.

That is, it is an aspect of the invention to make the screws 40 (ie., both its sections 46 and 48) from one material of one coefficient of thermal expansion while, in contrast, making the screw shafts 50 from another material having a different coefficient of thermal expansion such that following can be achieved. At ambient temperature, the screws 40 have a slip fit (eg., loose fit) on their screw shafts 50. But at operating temperature, the screws 40 have an interference fit with their screw shafts 50.

Hence the screws 40 and screw shafts 50 are made of dissimilar materials with dissimilar coefficients of thermal expansion. The screw shafts 50 are to have the higher value.

As an aside, the coefficient of thermal expansion is the measure of a material's volumetric expansion or contraction when it changes temperature. If the material expands when heated, it has a 'positive' coefficient of thermal expansion. Conversely, if the material expands when cooled, it has a 'negative' coefficient of thermal expansion.

The screws 40 and screw shafts 50 could be made in accordance with the invention with materials that both have positive coefficients of thermal expansion, or negative coefficients of thermal expansion. As long as there is a sufficient differential in the values of respective coefficients of thermal expansion such that the values of the coefficient of thermal expansion for the screw shafts 50 are substantially higher than the coefficient of thermal expansion for the screws 40, the screws 40 will fix onto the screw shafts 50 at operating temperature.

And then when cool (ie., ambient temperature), the interference fit will relax into a slip fit, and for ease of disassembly (or re-assembly).

The preferred design in accordance with the invention comprises the following. The screw shafts 50 are made from a steel alloy. Conversely, the screws 40 are made from a material with a comparatively low coefficient of thermal expansion, including without limitation NiResist grade D-5. The NiResist has a coefficient of thermal expansion that is about 40% of the coefficient of thermal expansion for steel. At ambient temperature, the screws 40 have central bores 80 which sized for a very close slip fit over screw shafts 50. The fit between the screws 40 and screw shafts 50 changes from a 'slip' fit when cool (ie., ambient) to an 'interference' fit at operating temperature, and then reverts back to a slip fit when cool again.

In reality, at operating temperature, the screws 40 are not one uniform temperature. FIG. 11 is a partial section view comparable to FIG. 4 except showing a pressure-to-axis curve alongside the screw 40 and shaft 50 to show the interface pressure between the screw 40 and shaft 50 at the hot running-temperature after the interference affect has taken affect. The axial axis is denominated as the Z-axis. The interface pressure is denominated as the P-axis. The second stage 48 will, on average, be hotter than the first stage 46. Hence the 'interference' fit phenomenon is likely to be magnified in the second stage 48. Nevertheless, that is still a welcome result. The second stage 48 is where most of the compression work transpires. Hence the second stage 48 is where there is a higher force of torque trying to break the interference fit between screw 40 and screw shaft 50. The result that the interference is tighter between the second stage 48 and shaft 50 versus first stage 46 and shaft 50 is therefore a good thing. That is where the interference fit needs to be tightest.

Accordingly, it is an aspect of the invention to use of materials having dissimilar coefficients of thermal expansion such that the augmented centering and positive locking of the screws 40 to the shaft 50 are achieved at operating temperatures.

In the drawings and description, the screws 40 are shown and described in connection with being vertical. However, screw pumps can be mounted in other orientations and, accordingly, terms like "top," "high," "low," "lift" or "sink" are used merely for convenience in this description and do not limit the invention to any particular use orientation.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. A screw pump (20), comprising:

at least two screws (40) having helical flights intermeshing with each other during rotation, and extending between inner and outer ends (44 and 42);

a base (26);

a shaft (50) for each screw (40), and extending between an inner end (68) and an outer end (74), as well as cantilevered from the base (26) proximate the inner end (68);

each screw (40) formed with a hollow core (80) for receiving the shaft (50) such that the screw (40) slips onto the respective shaft (50) therefor over the outer end (74) thereof;

an axial clamping arrangement (56) intermediate each shaft (50) and screw (40), and operative to rotationally lock the shaft (50) and without a key or keyway;

wherein each shaft (50) is formed with and instep proximate the outer end, which produces a shoulder (74);

wherein each axial clamping arrangement (56) comprises a pair of jaws (54 and 68) connected to or formed on the shaft (50), wherein at least one jaw (54) is movable and driven to produce clamping pressure;

wherein each movable jaw (54) comprises a ring (54) which fits inside the annular cavity between the necked-in shaft (50) beyond the shoulder (74) thereof and the core (80) in the screw (40) proximate the outer end (42) thereof; and wherein the movable jaw (54) is driven by threaded rod engaged to the shaft (50) at the shoulder (74).

2. The screw pump (20) of claim 1, wherein:

the axial clamping arrangement (56) is releasable such that, while released and not locked, timing between the screws (40) can be adjusted by rotationally slipping the screws (40) about the shafts (50).

3. The screw pump (20) of claim 1, wherein:

wherein the axial clamping arrangement (56) is not only disposed intermediate the respective shaft (50) and screw (40) therefor but also disposed proximate the outer ends (74 and 42) thereof.

4. The screw pump (20) of claim 1, wherein:

wherein the screw shaft (50) is stepped-in beyond the shoulder (74) and defines an annular cavity with the hollow core (80) in the screw (40);

whereby this annular cavity provides working room for the introduction and functioning of the axial clamping arrangement (56).

5. The screw pump (20) of claim 1, wherein:

each screw (40) is configured with an inner and outer seat (44 and 66) upon which the jaws (68 and 54) of the axial clamping arrangement (56) clamps onto.

6. A screw pump (20), comprising:

at least two screws (40) having helical flights intermeshing with each other during rotation, and extending between inner and outer ends (44 and 42);

a base (26);

a shaft (50) for each screw (40), and extending between an inner end (68) and an outer end (74) as well as cantilevered from the base (26) proximate the inner end (68);

each screw (40) formed with a hollow core (80) for receiving the shaft (50) such that the screw (40) slips onto the respective shaft (50) therefor over the outer end (74) thereof;

a keyless locking mechanism (56, 58, 96, or 98) intermediate each shaft (50) and screw (40), and operative to rotationally lock the screw (40) together without a key or keyway;

the screws (40) are produced of materials having coefficient of thermal expansion properties; and the shafts (50) are produced of dissimilar materials having coefficient of thermal expansion properties that are higher in value than the coefficient of thermal expansion properties of the screws (40) across a temperature range from ambient to operating temperatures;

wherein the screws (40) and shafts (50) have a slip fit at ambient temperatures, and also have an interference fit at operating temperatures that further promotes the centering and positive locking of the screws (40) to their shafts (50); and wherein the shaft (50) comprises a steel alloy and the screw (40) comprises a material with about zero percent (0%) thermal expansion over the temperature range from ambient to operating temperature.

7. The screw pump (20) of claim 6, wherein:

keyless locking mechanism (56, 58, 96, or 98) comprises any one of an axial clamping arrangement (56), a drift-free style of keyless bushing (96), a lift-style of keyless bushing (58), or a sink-style of keyless bushing (98).

8. The screw pump (20) of claim 7, wherein:

the keyless locking mechanism (56, 58, 96, or 98) comprises a combination of the axial clamping arrangement (56) with also one of the keyless bushings (58, 96, or 98).

9. A screw pump (20), comprising:

at least two screws (40) having helical flights intermeshing with each other during rotation, and extending between inner and outer ends (44 and 42);

a base (26);

a shaft (50) for each screw (40), and extending along an axis between an inner end (68) and an outer end (74), as well as cantilevered from the base (26) proximate the inner end (68);

each screw (40) formed with a hollow core (80) for receiving the shaft (50) such that the screw (40) slips onto the respective shaft (50) therefor over the outer end (74) thereof;

an annular keyless locking mechanism (56, 58, 96, or 98) intermediate each shaft (50) and screw (40), and operative to rotationally lock the shaft (50) and screw (40) together without a key or keyway;

each annular keyless locking mechanism (56, 58, 96, or 98) comprising plural fasteners arranged in an annular pattern around the respective shaft (50) that twist to lock and untwist to unlock said annular keyless locking mechanism (56, 58, 96, or 98) by twisting on respective axes that are arranged in said annular pattern around the respective axis of each annular keyless locking mechanism (56, 58, 96, or 98)'s respective shaft (50).

10. The screw pump (20) of claim 9, wherein:

the annular keyless locking mechanism (56, 58, 96, or 98) is releasable by untwisting the plural fasteners therefor on respective axes thereof that are arranged in an annular pattern around the axis of the shaft (50) such that, while released and not locked, timing between the screws (40) can be adjusted by rotationally slipping the screws (40) about the shafts (50).

11. The screw pump (20) of claim 9, wherein:

wherein each annular keyless locking mechanism (56, 58, 96, or 98) comprises at least four fasteners that twist to lock and loosen to unlock said annular keyless locking mechanism (56, 58, 96, or 98) on four respective twisting axes arranged in an annular pattern around the respective axis of the respective shaft (50).

12. The screw pump (20) of claim 9, wherein:

each shaft (50) is formed with and instep proximate the outer end, which produces a shoulder (74); and wherein the screw shaft (50) is stepped-in beyond the shoulder (74) and defines an annular cavity with the hollow core (80) in the screw (40);

whereby this annular cavity provides working room for the introduction and functioning of the annular keyless locking mechanism (56, 58, 96, or 98).

13. The screw pump (20) of claim 9, wherein:

the annular keyless locking mechanism (56, 58, 96, or 98) comprises any one of an annular axial clamping arrangement (56), an annular drift-free style of keyless bushing (96), an annular lift-style of keyless bushing (58), or an annular sink-style of keyless bushing (98).

14. The screw pump (20) of claim 13, wherein:

each annular axial clamping arrangement (56) comprises a pair of ring jaws (54 and 68) connected to or formed on the shaft (50), wherein at least one ring jaw (54) is movable and driven to produce clamping pressure.

15. The screw pump (20) of claim 14, wherein:

each movable jaw (54) comprises a ring (54) which fits inside the annular cavity between the necked-in shaft (50) beyond the shoulder (74) thereof and the core (80) in the screw (40) proximate the outer end (42) thereof; and wherein the movable jaw (54) is driven by the plural twist fasteners for said annular axial clamping arrangement (56), and the plural twist fasteners comprise threaded rod engaged to the shaft (50) at the shoulder (74).

16. The screw pump (20) of claim 9, wherein:

the annular keyless locking mechanism (56, 58, 96, or 98) for each shaft (50) comprises a combination of the annular axial clamping arrangement (56) with also one of the annular keyless bushings (58, 96, or 98) proximate each other on the outer end (74) or the respective shaft (50).

17. The screw pump (20) of claim 16, wherein:

each annular keyless bushing (58, 96 or 98) comprises a pair of collars which interfit with each other by respective conic tapered sections such that twisting the fasteners to lock the annular keyless bushing (58, 96 or 98) causes the respective conic tapered sections to wedge into each other and provide a radial clamping force between the shaft (50) and screw (40); and each annular keyless bushing (58) comprises plural provisions (60) independent of the twist fasteners to force apart the wedged together conic tapered sections to unlock said annular keyless bushing (58).

* * * * *